US005392468A

United States Patent [19]

Leddick, III

[11] Patent Number: 5,392,468

[45] Date of Patent: Feb. 28, 1995

[54] PROTECTIVE HEAD GEAR FOR MARTIAL ARTS ACTIVITIES

[76] Inventor: Robert S. Leddick, III, 377 A Lyman Rd., North Rose, N.Y. 14516

[21] Appl. No.: 108,294

[22] Filed: Aug. 19, 1993

[51] Int. Cl.[6] ..... A42B 3/00

[52] U.S. Cl. ..... 2/424; 2/425

[58] Field of Search ..... 2/9, 410, 411, 412, 2/414, 424, 425, 416, 417, 205

[56] References Cited

U.S. PATENT DOCUMENTS

| | | | |
|---|---|---|---|
| 1,517,886 | 12/1924 | Austin | 2/9 |
| 2,777,127 | 1/1957 | Marietta | 2/9 |
| 3,242,500 | 3/1966 | Derr | 2/205 |
| 3,820,780 | 6/1974 | Tarbox | 2/425 |
| 4,317,239 | 3/1982 | Bryksa | 2/411 |
| 4,446,576 | 5/1984 | Hisataka | 2/412 |
| 4,698,852 | 10/1987 | Romero | 2/411 |
| 4,856,119 | 8/1989 | Häberle | 2/417 |
| 5,012,533 | 5/1991 | Raffler | 2/425 |
| 5,093,936 | 3/1992 | Copeland et al. | 2/424 |

*Primary Examiner*—Clifford D. Crowder
*Assistant Examiner*—Michael A. Neas
*Attorney, Agent, or Firm*—Fred L. Denson

[57] ABSTRACT

Protective head gear is described which is suitable for use in martial arts activities. The protective head gear has four main components which provide increased protection to vulnerable parts of the head and neck. The main components are 1) a head mask, 2) a face guard for protecting facial areas, 3) a neck guard for protecting the back of the neck and 4) a cap for protecting the top of the head.

6 Claims, 3 Drawing Sheets

PROTECTIVE HEAD GEAR FOR MARTIAL ARTS ACTIVITIES

BACKGROUND OF THE INVENTION

1. Field of the Invention

The present matter relates to protective head gear used in martial arts activities which provides added protection against injury to the top and back of the head, back of the neck and facial areas.

2. Description of the Prior Art

Protective head gear is required to be worn by those who participate at the amateur level in various types of martial arts activities such as tae kwon do, karate and the like. Such head gear covers the front and sides of the face and is usually made from a protective material such as high impact foam having a naugahyde covering. The mouth, nose and eye areas are ordinarily left uncovered for vision, breathing and ventilation purposes. Little or no protection is provided to the top or back of the head except for a fastener used to connect the sides of the head gear at the back of the head. In order to increase its comfortability, the protective head gear often contains ventilation openings in various locations which do not interfere with its protective qualities.

Notwithstanding the fact that protective head gear must be approved by international sanctioning organizations before it can be used during competition, injuries to the head still occur. While certain rules have been promulgated which make blows to the top and back of the head illegal and while this has reduced the possibility of injury, such blows inadvertently occur during intense competition. Moreover, when an illegal blow is struck to an area that is not protected by head gear, the force of such a blow can cause serious injury. Hence, there is a need for protective head gear that provides increased protection to the top and back of the wearer's head and neck and to the facial areas.

It is therefore an object of the invention to provide protective head gear that is suitable for use in martial arts activities and which provides increased protection against head and neck injuries.

It is a further object of this invention to provide protective head gear which is adjustable, comfortable and well ventilated.

It is still another object of this invention to provide protective head gear that is structured to permit good ventilation without compromising its protective features.

SUMMARY OF THE INVENTION

In accordance with the present invention, protective head gear is provided which has four main protective components. Each of these components is positioned in a manner which provides increased protection to vulnerable parts of the head and neck. The protective head gear is conveniently adjustable to fit the size and shape of the head of the wearer. It also has a number of ventilation channels and openings which are selectively placed for the efficient removal of body heat from within the head gear while not interfering with its protective features.

The four basic components of the head gear of this invention include a head mask, a face guard for protecting facial areas, a neck guard for protecting the back of the neck and a cap for protecting the top of the head. The head mask has a front and sides and is made from a protective material which covers the front and side of the face. Each side has an ear opening and the front has an opening in the mouth, nose and eye areas. The face mask is mounted on the opening in the front and has a clear plastic shield for protecting the eyes and an open network of intersecting plastic bars for protecting the nose and mouth areas. The cap is a separate piece which is connected to the top of the sides of the head mask in a manner such that it is maintained in a suspension position without contacting the sides. Each side of the head mask contains a flap attached thereto which forms a rear extension of the side. The flaps are connected in a manner such that they form a neck guard which fully covers and protects the back of the neck. Connectors are positioned on the overlapping portions of the flaps and are fastenable in a manner that permits the head gear to be easily adjusted to fit the head of the user.

While the protective head gear described herein is particularly suitable for use in tae kwon do activities, it is also useful in karate as well as in other types of martial arts. It can be used as well in any other combative sports which require head gear such as amateur boxing and wrestling.

The invention and its objects and advantages will become more apparent by referring to the accompanying drawings and to the ensuing detailed description of the preferred embodiment.

DETAILED DESCRIPTION OF THE PREFERRED EMBODIMENTS

Figure 1:
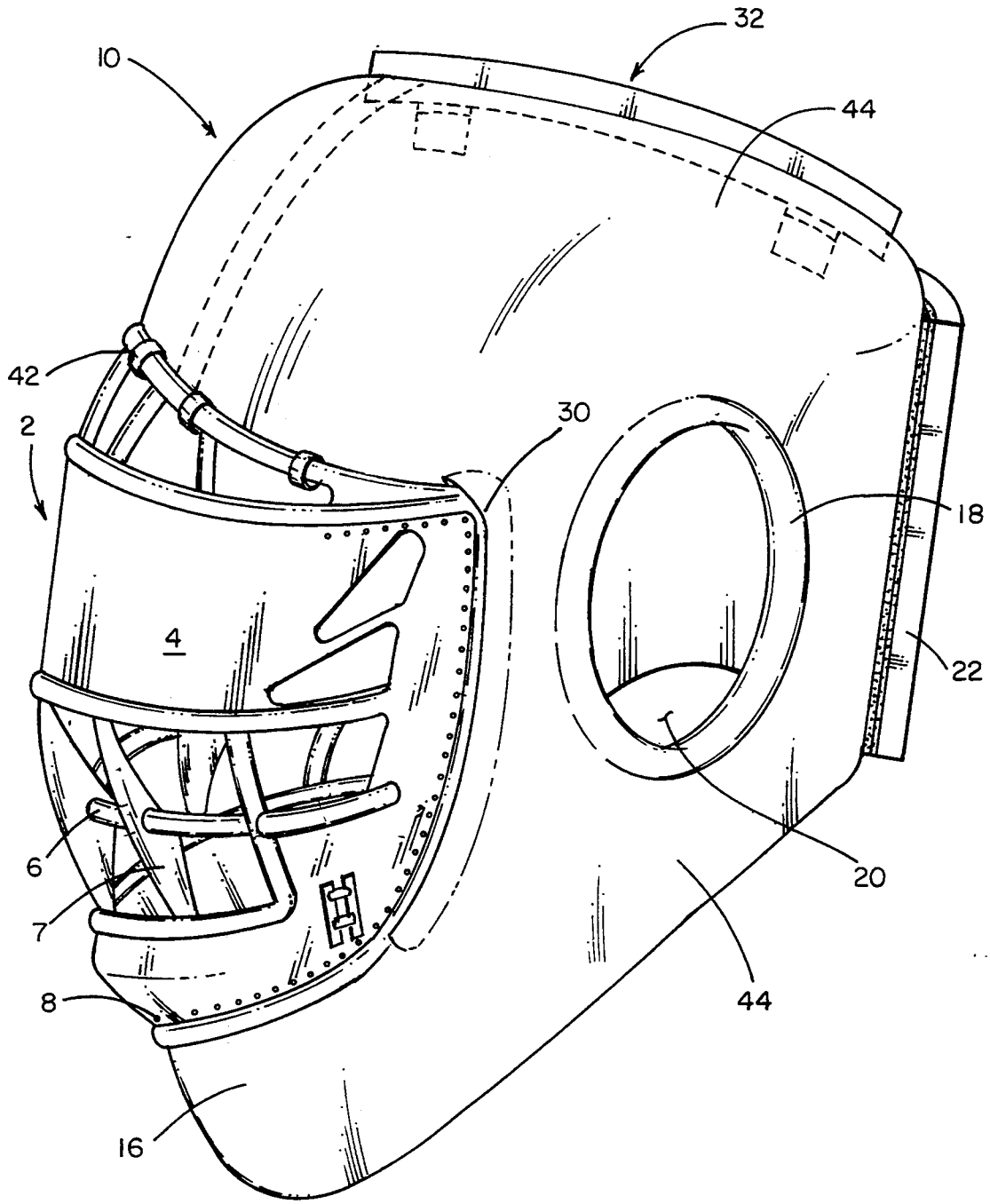
FIG. 1 is a pictorial side view of the protective head gear of this invention.
Figure 2:
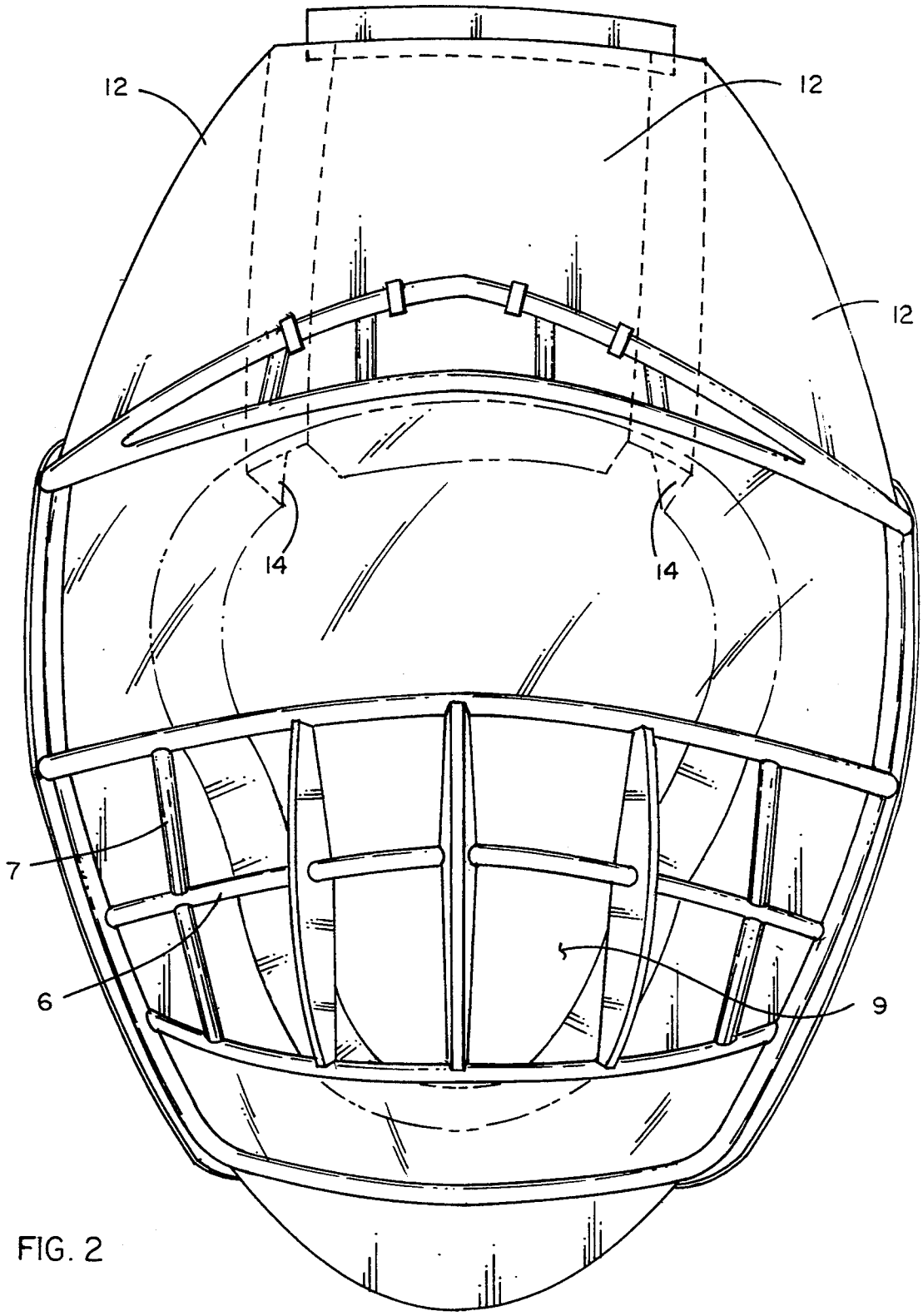
FIG. 2 is a pictorial front view of the protective head gear of this invention.

As shown in FIGS. 1 and 2, the protective head gear of this invention includes head mask 10, face guard 2, neck guard 22 and cap 32. Face guard 2 is mounted on an opening in the front of head mask 10 and is secured thereto by a series of straps 42 and stitching 8. Because the corners of face guard 2 can cause injury if left exposed, they are mounted in pockets 30 provided in head mask 10 to provide additional safety to combatants during competition. The upper part of face guard 2 includes clear plastic eye shield 4. Its lower part consists of a series of intersecting horizontal and vertical plastic bars, 6 and 7, and openings 9 which form a lattice-like structure for protecting the mouth and nose while permitting the passage of air therethrough for heat ventilation and breathing. Upper part 12 of head mask 10 protects the areas of the face which are above face guard 2 such as the forehead, while lower part 16 protects the chin.

Each side, 44 and 46, of head mask 10 contains ear opening 20. Protective ear guard 18, which consists of a rim of protective material, is positioned along the periphery of ear opening 20. Opening 20 enhances hearing and heat ventilation while ear guard 18 provides added protection against injury which might result from blows to the ear and temporal areas.

Figure 3:
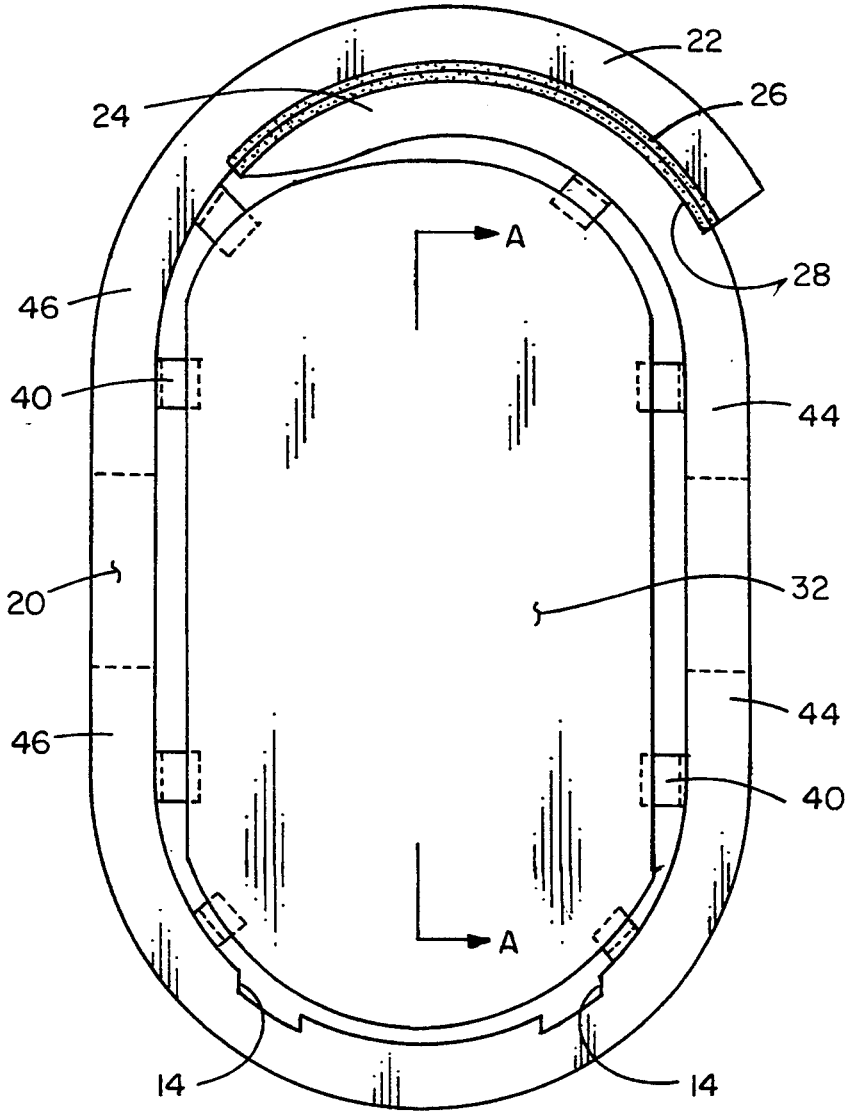
FIG. 3 is a top plan view of the protective head gear of this invention.

As shown in FIGS. 1 and 3, the back of the combatant's neck is protected by overlapping flaps 22 and 24. Flap 22 is attached to the rear of side 46 so as to form an extension thereof, Flap 24 is attached to the rear of side 44 in the same manner. Flaps 22 and 24 are of sufficient length to fully cover the nape of the combatant's neck. They are also of sufficient width to completely overlap in the area covering the back of the neck. This arrangement provides added protection for this area. Velcro fasteners 26 and 28 are positioned on the overlapping surfaces of flaps 22 and 24. This feature allows the head gear to be adjusted to securely fit the combatant's head.

The top of the protective head gear consists of cap 32 which is maintained in a suspended position between sides 44 and 46 by elastic connecting bands 40. While elastic connecting bands 40 attach cap 32 to sides 44 and 46, there is no direct contact between cap 32 and the sides. Because cap 32 is maintained in a suspended position by elastic connecting bands 40, it is snugly positioned on the top of the head of the combatant. Moreover, cap 32 has a slight curvature which is conformable to the curvature of the top of the combatant's head. This configuration helps to secure cap 32 in its protective position while providing for adequate heat ventilation through channels 14.

Figure 4:
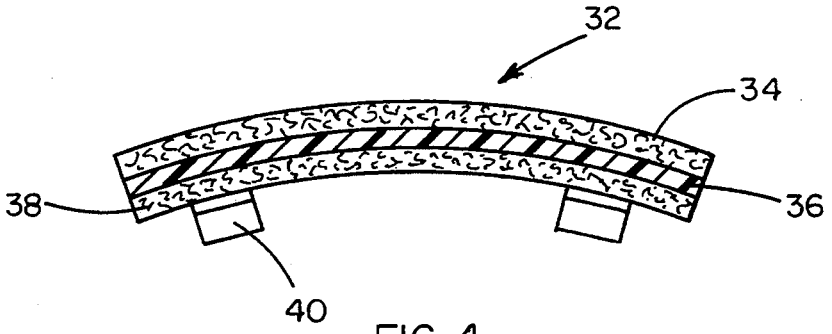
FIG. 4 is a partial cross section view taken along line A—A of the protective head gear of FIG. 3.

The front, sides and neck flaps of head mask 10 are made from any protective materials conventionally used for head masks in combative sports such as boxing, wrestling and the like. These include various types of polymeric foam materials such as a high impact foam typically having a naugahyde covering. Face guard 2 is made from any hard, clear plastic material such as an acrylic resin. Cap 32 contains three layers of protective material as shown in FIG. 4. A layer of hard, solid thermoplastic material 36 is disposed between two layers 34 and 38 of the type of protective material used in other parts of the head gear. Layer 36 is attached to layers 34 and 38 by any suitable adhesive bonding material. The hard center layer provides maximum protection to the top of the head while the outer layers provide shock absorption as well as protection.

The invention has been described with reference to a preferred embodiment thereof. However, variations and modifications can be effected within the spirit and scope of the invention.

I claim:

1. Protective head gear for martial arts activities comprising:

a. a head mask for protecting the front and sides of a user's face, said head mask comprising
   i. a front having an opening therein,
   ii. a first side having an opening therein,
   iii. a second side having an opening therein, wherein said front is attached to and disposed between said first and said second sides;

b. a transparent face guard having openings therein for protecting the user's eyes, nose and mouth, said face guard being mounted on the opening in the front of the head mask;

c. a neck guard for protecting the nape of the user's neck, said neck guard comprising
   i. a first flap which is attached to said first side so as to form an extension thereof,
   ii. a second neck flap which is attached to said second side so as to form an extension thereof,
   iii. fastening means attached to said first and second flaps for joining said flaps together in a manner such that they fully cover the nape of the user's neck;

d. a cap for protecting the top of the user's head, said cap comprising a piece of protective material having a shape which is conformable to the shape of the top of the user's head and which is attached to, but not in contact with, said first and second sides; and e. two ear guards each of which comprises an annular rim of protective material positioned on the periphery of the opening in said first and second sides.

2. The protective head gear described in claim 1 wherein the protective material for the cap comprises a layer of hard, solid thermoplastic material disposed between, and bonded to, two layers of thermoplastic foam material.

3. The protective head gear described in claim 1 wherein the front and sides of the face mask and the flaps of the neck guard are made from a protective thermoplastic foam material.

4. The protective head gear described in claim 1 wherein a part of the first and second flaps overlap when joined together with said fastening means.

5. The protective head gear described in claim 1 wherein the fastening means attached to said first and second flaps comprises hook and loop fasteners.

6. The protective head gear described in claim 1 wherein the face guard has an upper part comprising a solid, transparent plastic shield for protecting the user's eyes and a lower part attached thereto comprising a lattice-like structure of plastic bars for permitting the free flow of air therethrough for breathing and for protecting the user's nose and mouth.

* * * * *